US008077093B2

(12) United States Patent
Dean

(10) Patent No.: US 8,077,093 B2
(45) Date of Patent: Dec. 13, 2011

(54) PATCH RADIATOR WITH CAVITY BACKED SLOT

(75) Inventor: Stuart J. Dean, Kemptville (CA)

(73) Assignee: TenXc Wireless Inc., Ottawa, Ontario (CA)

( * ) Notice: Subject to any disclaimer, the term of this patent is extended or adjusted under 35 U.S.C. 154(b) by 513 days.

(21) Appl. No.: 12/293,183

(22) PCT Filed: Mar. 9, 2007

(86) PCT No.: PCT/CA2007/000385
§ 371 (c)(1),
(2), (4) Date: Oct. 17, 2008

(87) PCT Pub. No.: WO2007/106975
PCT Pub. Date: Sep. 27, 2007

(65) Prior Publication Data

US 2009/0091499 A1 Apr. 9, 2009

(30) Foreign Application Priority Data

Mar. 17, 2006 (CA) ..... 2540219

(51) Int. Cl.
*H01Q 1/24* (2006.01)

(52) U.S. Cl. ..... 343/700 MS

(58) Field of Classification Search ..... 343/700 MS
See application file for complete search history.

(56) References Cited

U.S. PATENT DOCUMENTS

| | | | | |
|---|---|---|---|---|
| 4,622,550 A | | 11/1986 | O'Connor et al. | 340/825.05 |
| 5,155,493 A | * | 10/1992 | Thursby et al. | 343/700 MS |
| 5,565,873 A | | 10/1996 | Dean | 342/372 |
| 5,576,717 A | | 11/1996 | Searle et al. | 342/373 |
| 5,596,329 A | | 1/1997 | Searle et al. | 342/374 |
| 5,602,555 A | | 2/1997 | Searle et al. | 342/374 |
| 5,603,089 A | | 2/1997 | Searle et al. | 455/53.1 |
| 5,714,957 A | | 2/1998 | Searle et al. | 342/374 |
| 5,881,369 A | | 3/1999 | Dean et al. | 455/78 |
| 5,990,835 A | | 11/1999 | Kuntzsch et al. | 343/700 |

(Continued)

FOREIGN PATENT DOCUMENTS

| | | |
|---|---|---|
| EP | 0 590 955 | 4/1994 |

(Continued)

OTHER PUBLICATIONS

European Patent Office Supplementary European Search Report (dated Mar. 30, 2009), Appl. No. EP 07 71 0717, 5 pp.

(Continued)

*Primary Examiner* — Tho G Phan

(74) *Attorney, Agent, or Firm* — Sunstein Kann Murphy & Timbers LLP

(57) ABSTRACT

A patch radiator for use in beamformed or steerable antenna systems which maximizes upper frequency limit and simultaneously minimizes the lower frequency limit, by providing an annular patch configuration in which a central region of the patch element is devoid of material, whereby this central region is of a different shape from the shape of the exterior perimeter of the patch element. One possible configuration of such a patch radiator comprises a square exterior shape, enclosing a central circular region of removed material. In this manner, the upper frequency limit threshold tends to rise as the interior annular perimeter is reduced. Preferably, the exterior and interior perimeters have no interior angles of more than 180°.

25 Claims, 4 Drawing Sheets

U.S. PATENT DOCUMENTS

| | | | | |
|---|---|---|---|---|
| 6,038,459 | A | 3/2000 | Searle et al. | 455/562 |
| 6,091,970 | A | 7/2000 | Dean | 455/562 |
| 6,421,542 | B1 | 7/2002 | Sandler et al. | 455/561 |
| 6,542,746 | B1 | 4/2003 | Dean | 455/447 |
| 6,906,674 | B2 | 6/2005 | McKinzie, III et al. | 343/767 |
| 7,362,283 | B2 | 4/2008 | Quintero Illera et al. | 343/846 |
| 2003/0011522 | A1 | 1/2003 | McKinzie, III et al. | 343/700 |
| 2004/0217916 | A1 | 11/2004 | Quintero Illera et al. | 343/895 |
| 2004/0222935 | A1 | 11/2004 | Jan et al. | 343/790 |

FOREIGN PATENT DOCUMENTS

| | | |
|---|---|---|
| EP | 0 847 103 | 6/1998 |
| GB | 2 272 575 | 5/1994 |
| WO | WO 02/063714 | 8/2002 |

OTHER PUBLICATIONS

Shafai et al. "*Bandwidth and Polarization Characteristics of Perforated Patch Antennas*", 10$^{th}$ International Conference on Antennas and Propagation, Conference Publication No. 436, pp. 1.43-1.46 (Apr. 1997).

International Searching Authority, International Search Report—International Application No. PCT/CA2007/00385, dated Jun. 17, 2007, together with the Written Opinion of the International Searching Authority, 8 pages.

International Bureau of WIPO, Article 19 Amendments and Reply to Written Opinion, dated Aug. 20, 2007, pertaining to International Application No. PCT/CA2007/00385, 7 pages.

* cited by examiner

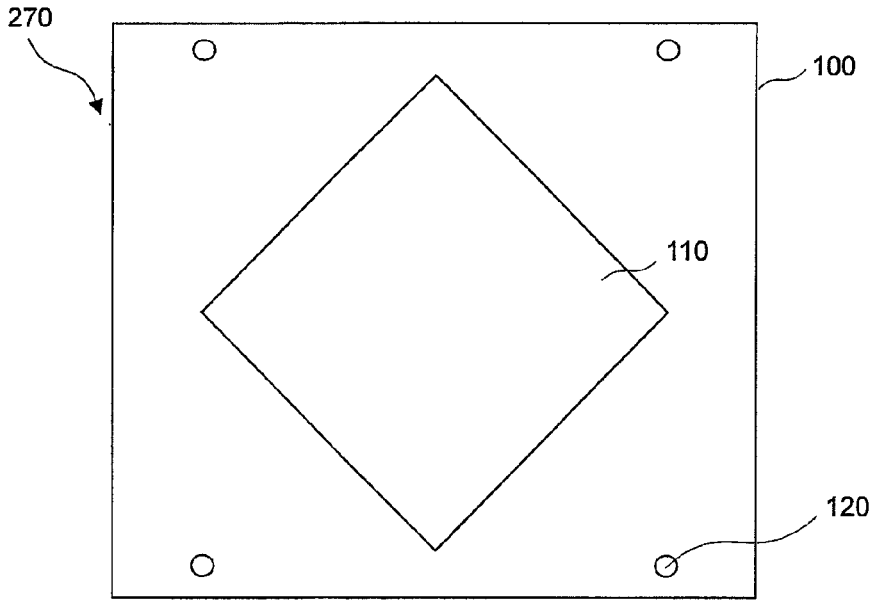
PriorArt
Figure 1A
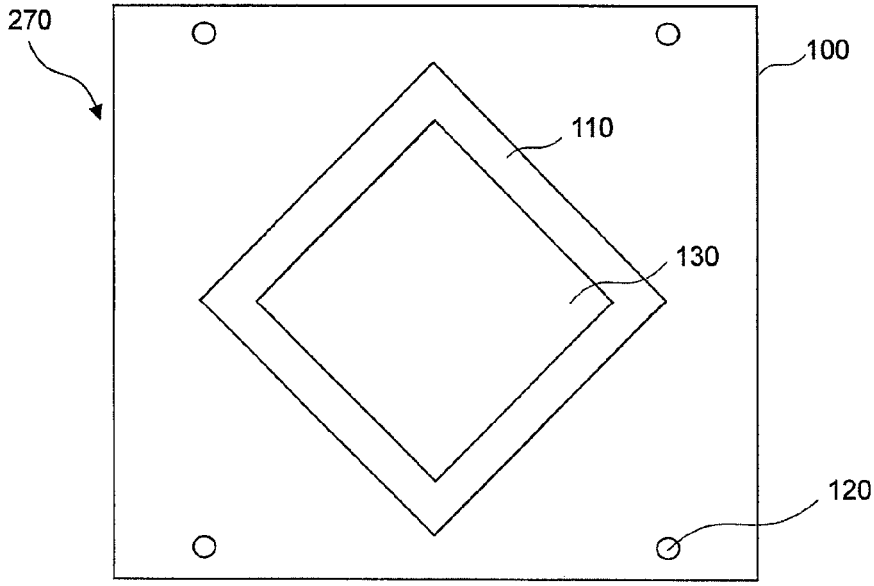
PriorArt
Figure 1C

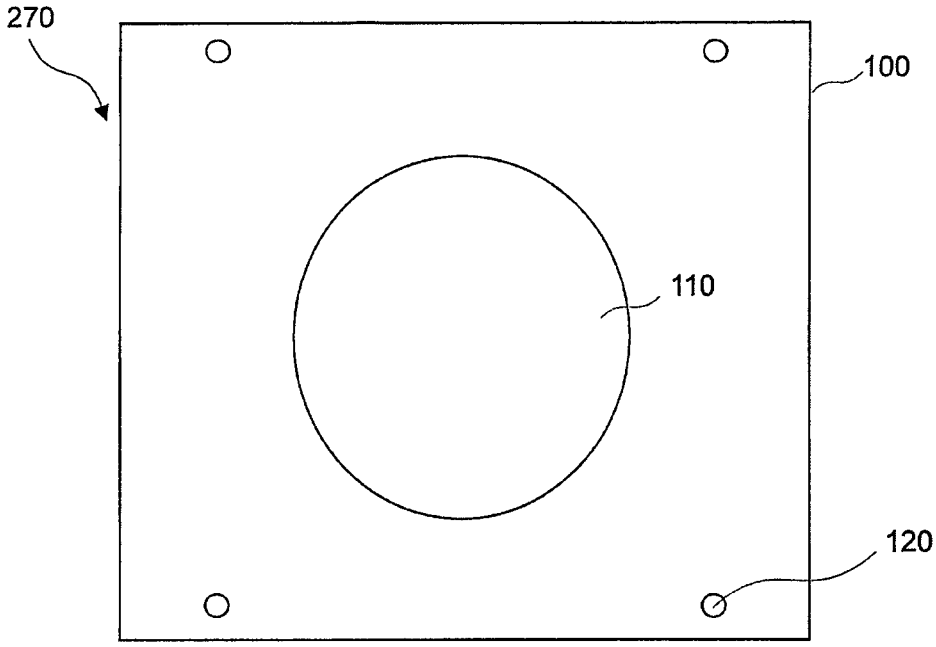
PriorArt
Figure 1B
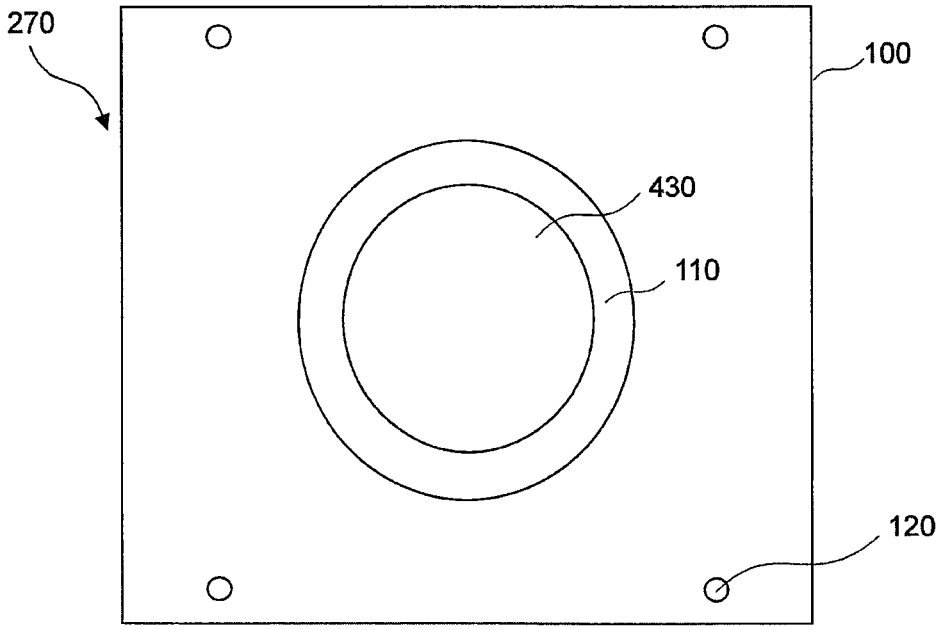
PriorArt
Figure 1D

PATCH RADIATOR WITH CAVITY BACKED SLOT

CROSS-REFERENCE TO RELATED APPLICATIONS

This application is a U.S. National Phase, and therefore claims priority from,PCT/CA2007/000385 having an international filing date of Mar. 9, 2007, which in turnclaims priority from CA 2,540,219 filed Mar. 17, 2006, each of which is herebyincorporated herein by reference in its entirety.

FIELD OF THE INVENTION

The present invention relates to antenna elements and in particular to patch radiators in cavity backed slot fed antenna elements.

BACKGROUND TO THE INVENTION

In beamformed or steerable antenna systems, such as may be used in base stations for cellular telephone networks, an antenna may be comprised of an array of identical antenna elements.

In one such design, known as a cavity backed, slot fed dual polarized patched element, the antenna element comprises, in order from the back of the radiating element to the front, a cavity structure, a dual feed network, a pair of slots and a patch radiator.

The cavity ensures that all of the radiated energy emerges from the front of the antenna element.

The dual feed network is largely to provide the necessary fields to drive the slot elements by exciting the appropriate field structure on the patch radiator.

The slots in turn excite the necessary fields for the dual polarized patch elements.

The patch radiator is the active or radiating part of the antenna element. The size and configuration of the patch radiator has a significant impact on the operating characteristics of the antenna element.

However, in beamformed antenna arrays, the spacing between the centres of adjacent rows and/or columns imposes a performance constraint. For example, those skilled in the relevant art will understand that exceeding array spacing threshold maxima may introduce grating lobes in the radiated signal, which is generally undesirable. As an exemplary rule of thumb, array elements may be restricted to no more than 0.5 wavelength spacing in the azimuthal plane and 0.8 wavelength spacing in the elevation plane. The greater wavelength spacing in the elevation plane is generally considered acceptable because typically the narrow beamwidth and low skew angle of the beam provides assistance so that the undesirable grating lobes cannot form.

Leaving aside the performance implications, it is generally desirable to optimize the array element spacing so as to produce an antenna array with a small physical footprint consistent with the required radiation patterns.

Therefore, care should be taken to design a patch element that provides satisfactory performance while satisfying the various design criteria of the radiating element. For example, it is generally accepted that for dual polarization elements, the two polarizations are set at +/−45°. This generally implies that a square patch radiator be oriented along a diagonal relative to the array.

As well, the antenna element should be designed to provide a suitable frequency bandwidth to accommodate the application for which it is intended.

It is generally understood, at least in a colloquial or empirical sense, if not strictly proven by electro-magnetic field calculations, that for patches that are defined by polygonal shapes that have no interior angles of less than 180°, the operating frequency is determined by the perimeter of the patch element. Thus, in order to minimize physical size of the patch, it is generally preferable to maximize the area enclosed relative to the enclosing perimeter. As such, typical patch shapes that have been successfully employed include square or rectangular patches, such as is shown in FIG. 1A. Other patch shapes include circular patches, such as is shown in FIG. 1B.

It is also generally understood, in the empirical sense at least, that the EM characteristics of such patches impose, as a design objective, that the patch perimeter may be on the order of 1.5 wavelengths in length.

On the other hand, it has been found that removing some patch material from the interior of the patch shape has an ameliorating effect on its EM characteristics such that, as a rule of thumb, the patch perimeter may be reduced to be on the order of 1.0 wavelengths in length. Clearly, this has salutary benefits for the antenna designer, who is constrained to minimize, so far as possible, the inter-element spacing of the antenna array.

This latter observation has resulted in a second generation of patch radiators, wherein the interior annular region of the patch element adopts the shape of the exterior perimeter so that the amount of material between the inner annular region and the exterior perimeter remains constant. Thus, for example, an exemplary conventional annular patch radiator might be a square with a corresponding square interior annular region of removed conductive material, such as is shown in FIG. 1C. For this class of annular patches the centre frequency is known to be inversely proportional to the inner and outer perimeters respectively. Another example might be a patch of circular shape, with an interior circular annular region of removed material, such as is shown in FIG. 1D.

The similarity of shape between the interior annular region and the exterior perimeter ensures that there is a relatively constant amount of material in the radiator as one proceeds along the exterior of its perimeter.

However, it has been found that the threshold upper frequency limit tends to increase in proportion to the ratio of the area of removed material defined by the interior annular region to the perimeter of such interior annular region. Accordingly, there is a need for an improved patch radiator configuration which maximizes upper frequency limit and simultaneously minimizes the lower frequency limit. In this regard, the present invention substantially fulfills this need.

SUMMARY OF THE INVENTION

Accordingly, it is desirable to provide a patch radiator configuration that maximizes upper frequency limit and simultaneously minimizes the lower frequency limit.

It is further desirable to provide a patch radiator configuration that is compact so as to facilitate other antenna design constraints.

The present invention accomplishes these aims by providing an annular patch configuration in which a central region of the patch element is devoid of material, whereby this central region is of a different shape from the shape of the exterior perimeter of the patch element.

While this introduces a difference in the amount of material in the radiator as one proceeds along the exterior of its perimeter, it has been found, as an empirical relation, that the threshold upper frequency limit tends to increase in proportion to the ratio of the area of removed material defined by the interior annular region to the perimeter of such interior annular region.

Put another way, the upper frequency limit threshold tends to rise as the interior annular perimeter is reduced.

According to a first broad aspect of an embodiment of the present invention, there is disclosed a patch radiator for an antenna element, comprising an annular region of planar conductive material defined by an exterior perimeter surrounding an interior perimeter contacting a support structure of dielectric material, wherein the exterior perimeter of the radiator is large relative to the area of the region enclosed thereby, and wherein the interior perimeter of the radiator is small relative to the area of the region enclosed thereby.

According to a second broad aspect of an embodiment of the present invention, there is disclosed a patch radiator for an antenna element, comprising an annular region of planar conductive material defined by an exterior perimeter surrounding an interior perimeter contacting a support structure of dielectric material, wherein the interior perimeter has a configuration which is different from that of the exterior perimeter.

According to a third broad aspect of an embodiment of the present invention, there is disclosed a patch radiator for an antenna element, comprising an annular region of planar non-conductive printable material defined by an exterior perimeter surrounding an interior perimeter contacting a support structure of dielectric material, wherein the exterior perimeter of the radiator is large relative to the area of the region enclosed thereby, and wherein the interior perimeter of the radiator is small relative to the area of the region enclosed thereby.

The advantage of the present invention is that it provides an improved patch radiator configuration that maximizes upper frequency limit and simultaneously minimizes the lower frequency limit, by providing an annular patch configuration in which a central region of the patch element is devoid of material, whereby this central region is of a different shape from the shape of the exterior perimeter of the patch element.

A further advantage of the present invention is that it provides an improved patch radiator configuration that is compact so as to facilitate other antenna design constraints.

BRIEF DESCRIPTION OF THE DRAWINGS

The embodiments of the present invention will now be described by reference to the following figures, in which identical reference numerals in different figures indicate identical elements, and in which:

FIGS. 1A-1D show various embodiments of a conventional patch radiator for use in a beamformed or steerable antenna system;

DESCRIPTION OF THE PREFERRED EMBODIMENT

Figure 2:
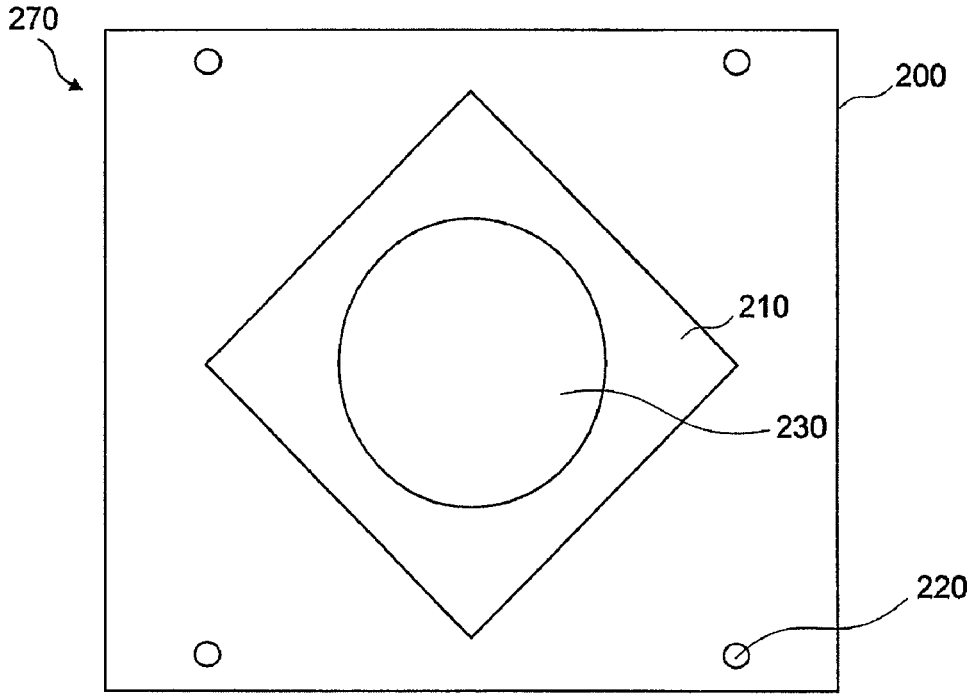
FIG. 2 shows a patch radiator for use in a beamformed or steerable antenna system, in accordance with a preferred embodiment of the present invention.

As is known in the art, and as previously noted, a patch radiator is the active or radiating part of the antenna element. It is also well known in the art that, in a crossed slot fed dual polarized antenna element, the patch radiator is frequently provided to boost the radiated energy, which may have become attenuated or degraded as a result of any cross-coupling between the two polarizations.

Usually, a patch radiator is annular and can be silkscreened onto a substrate such as polycarbonate using a highly conductive ink, such as a silver-loaded ink, or etched copper on a microwave quality printed circuit board or solid metal suspended by plastic spacers. FIGS. 1A through 1D illustrate various possible examples of conventional patch radiators or patch elements. As shown in FIGS. 1A through 1D, the patch radiator 270 can comprise patch element 110, printed on a supporting board structure 100 mounted over the remainder of the antenna elements via mounting holes 120. Optionally, a central region of the patch element 110 may be devoid of material 130, as seen in FIGS. 1C and 1D. In the examples shown in FIGS. 1C and 1D, it can be seen that the interior annular region of the patch element adopts the shape of the exterior perimeter so that the amount of material between the inner annular region and the exterior perimeter remains constant, whereby the centre frequency is known to be inversely proportional to the inner and outer perimeters respectively.

The present invention, however, relates to an improved patch radiator configuration which maximizes upper frequency limit and simultaneously minimizes the lower frequency limit, by providing an annular patch configuration in which the interior region of removed material is different from the shape of the exterior perimeter.

The general arrangement of the patch element of the present invention is shown in FIG. 2. The patch element 210 is printed on a supporting board structure 200 mounted over antenna elements via mounting holes 220. It can be seen in FIG. 2 that a central region of the patch element 210 is devoid of material 230, and that this central region devoid of material is of a different shape from the shape of the exterior perimeter of the patch element 210. In a preferred embodiment, the exterior perimeter of the patch radiator is approximately equal to the length of the operating wavelength of the antenna array.

Those having ordinary skill in this art will recognize that the proportion of enclosed area as a function of perimeter of a polygon generally increases with the number of equal length sides. Theoretically, therefore, a circle maximizes the enclosed area as a function of its perimeter, while a triangle minimizes its enclosed area as a function of perimeter.

Preferably, the exterior and interior perimeters have no interior angles of more than 180°. More preferably, the exterior and interior perimeters are regular polygons, that is, polygons that have sides of equal length and equal angles.

However, because the patch element is to be used for a dual polarized antenna element, it would be preferable if the polygon exhibited orthogonal axes. Thus, the smallest suitable polygon may be the square.

Accordingly, one exemplary configuration of a suitable patch element, as shown in FIG. 2, comprises the patch element 210 having a square exterior perimeter, enclosing a central circular region 230 of removed material.

The supporting board structure 200 may be manufactured using a variety of materials such as foam, sheet or composite dielectric materials. Suitable foam dielectrics may include polystyrene, polyurethane, or a mixture thereof. Suitable sheet dielectrics may include polystyrene, polycarbonate, Kevlar®, Mylar® or mixtures thereof. Suitable composite dielectrics may include Duroid®, Gtek®, FR-4®, or mixtures thereof. Alternative support structures would be known to practitioners of the art, and it would be well understood that these could be substituted.

Printed or bonded on this support structure is patch element 210, which could be made of conductive materials such as copper, aluminum or silver. Other materials which could also be utilized, and which would be apparent to one skilled in the art, include iron, brass, tin, lead, nickel, gold or mixtures thereof. It may also be printed, such as through silkscreening, onto the support structure of dielectric material using suitable high conductivity inks.

It appears that the performance of the patch element improves with the conductivity of the patch material. Thus, preferably the patch element is made out of a planar conductive material such as copper sheeting.

Alternatively, the patch element may be constructed out of a non-conductive printable material, such as polycarbonate, on which a pattern corresponding to the shape of the patch element is silkscreened, preferably using a highly conductive ink such as a silver loaded ink, in order to reduce manufacturing cost and to increase production. Other inks of varying conductivities could also be used such as gold-loaded ink, tin-loaded ink, aluminum-loaded ink, brass-loaded ink or mixtures thereof, as would be known to a person skilled in the art.

Figure 3:
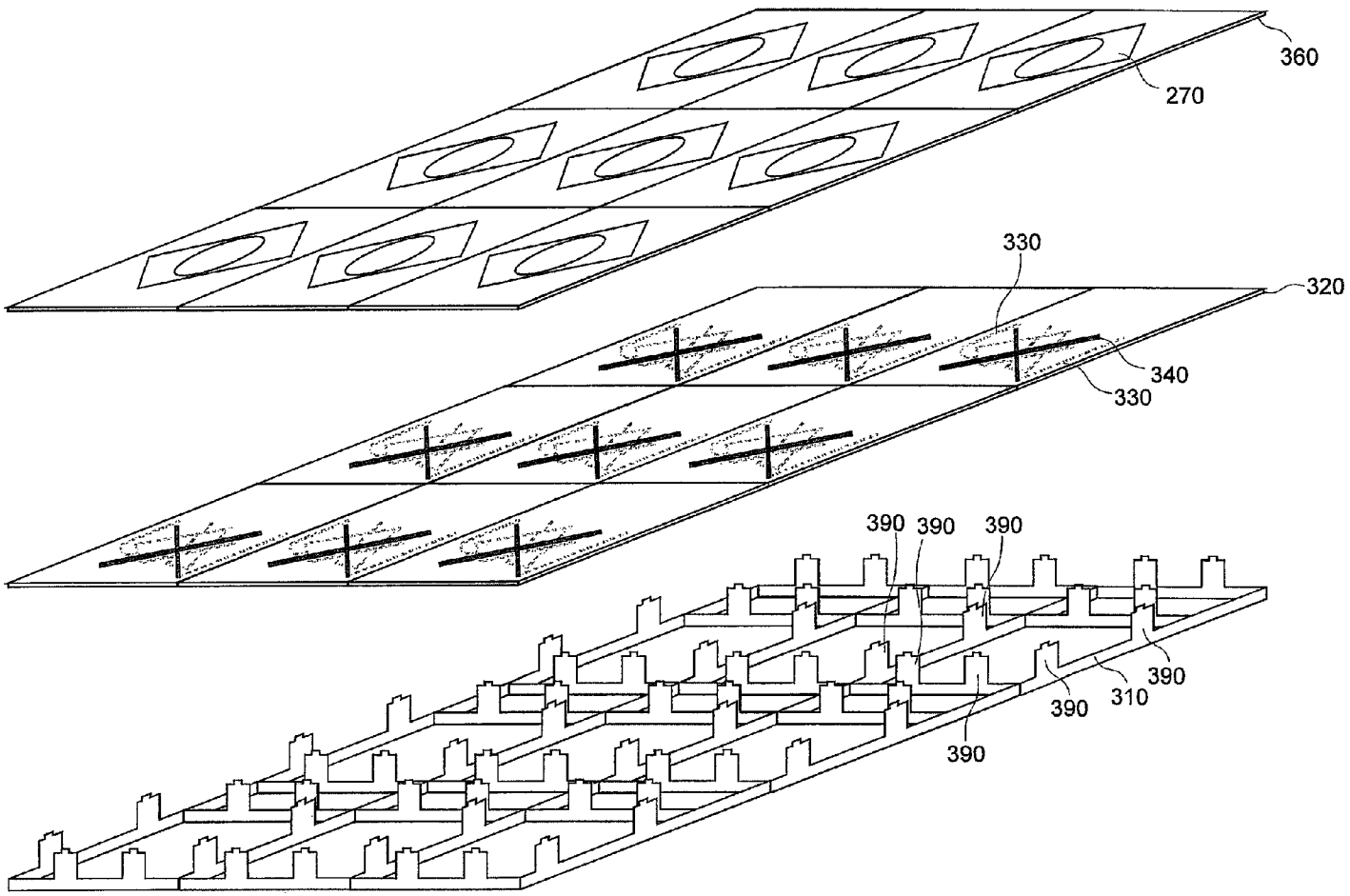
FIG. 3 is a partially exploded view of a composite polarization antenna array, and which utilizes the embodiment of the patch radiator shown in FIG. 2.

With reference to FIG. 3, there is provided an exploded view of an example of a composite polarization antenna element, and shown utilizing the patch radiator 270 of the present invention. Such an antenna element comprises additional components that one of ordinary skill in the relevant art might use to implement and utilize in conjunction with such a patch radiator, namely, in order from the back of the radiating element to the front, a cavity structure 310, a dual feed network 330 (in dashed outline), a double sided printed circuit board 320, a pair of crossed slots 340, a plurality of field suppression fingers 390, and the patch radiator 270 of the present invention on a substrate 360. The dual feed network and dual slots are largely to provide fields to drive the patch radiator 270 by exciting the appropriate field structure on the patch radiator 270. It will be understood that the dual feed network is in dashed outline in FIG. 3, as the feed network 330 and the slots 340 are mounted on opposite sides of the double sided printed circuit board 320 supported by the cavity structure 310, with the dual feed network 330 disposed on the surface of the double sided printed circuit board 320 and facing the inside the cavity structure 310, and with the slots 340 facing toward the patch radiator 270. In the example shown in FIG. 3, and as would be apparent to one skilled in the art, the plurality of field suppression fingers 390 are built into the cavity structure 310 and are used to support the double sided printed circuit board 320 and patch radiator 370 thereon, the fingers 390 being provided on four of the sides of the cavity structure 310 to control and limit any mutual coupling between elements.

Other embodiments consistent with the present invention will become apparent from consideration of the specification and the practice of the invention disclosed therein.

Accordingly, the specification and the embodiments described therein are to be considered exemplary only, with a true scope and spirit of the invention being disclosed by the following claims.

What is claimed is:

1. A patch radiator for an antenna element comprising:

a support structure; and a polygonal plating of conductive material, operatively contacting the support structure, the polygonal plating having a polygon perimeter length and an aperture located therein having an aperture perimeter;

wherein configurations of the polygonal plating and the aperture are selected such that (i) a ratio of the polygon perimeter length to the area of the polygon is maximized; and (ii) a ratio of the aperture perimeter to the aperture area is minimized.

2. A patch radiator according to claim 1, wherein the polygon perimeter is a polygon.

3. A patch radiator according to claim 2, wherein the polygon perimeter has no interior angles greater than 180° .

4. A patch radiator according to claim 2, wherein the polygon perimeter is a regular polygon.

5. A patch radiator according to claim 2, wherein the polygon perimeter is a square.

6. A patch radiator according to claim 1, wherein the polygon perimeter length is approximately equal to an operating wavelength of the antenna array.

7. A patch radiator according to claim 1, wherein the aperture perimeter is selected from a group consisting of a polygon and a circle.

8. A patch radiator according to claim 7, wherein the aperture perimeter is a polygon that has no interior angles greater than 180° .

9. A patch radiator according to claim 7, wherein the aperture perimeter is a polygon that is a regular polygon.

10. A patch radiator according to claim 7, wherein the aperture perimeter is a circle.

11. A patch radiator according to claim 1, wherein the conductive material is selected from a group consisting of copper, iron, brass, aluminum, tin, lead, nickel, gold and mixtures thereof.

12. A patch radiator according to claim 1, wherein the support structure is a foam dielectric material.

13. A patch radiator according to claim 12, wherein the foam dielectric material is selected from a group consisting of polystyrene, polyurethane and mixtures thereof.

14. A patch radiator according to claim 1, wherein the support structure is a sheet dielectric material.

15. A patch radiator according to claim 14, wherein the sheet dielectric material is selected from a group consisting of polystyrene, polycarbonate, Kevlar®, Mylar® and mixtures thereof

16. A patch radiator according to claim 1, wherein the support structure is a composite dielectric material.

17. A patch radiator according to claim 16, wherein the composite dielectric material is selected from a group consisting of Duroid®, Gtek®, FR-4® and mixtures thereof.

18. A patch radiator according to claim 1, wherein the conductive material is a conductive ink.

19. A patch radiator according to claim 18, wherein the conductive ink is printed onto the support structure of dielectric material.

20. A patch radiator according to claim 19, wherein the conductive ink is silkscreened onto the support structure.

21. A patch radiator according to claim 18, wherein the conductive ink is selected from a group consisting of silver-loaded ink, gold-loaded ink, tin-loaded ink, aluminum-loaded ink, brass-loaded ink and mixtures thereof.

22. A patch radiator according to claim 1, wherein the support structure is a dielectric material.

23. A patch radiator for an antenna element comprising:

a support structure; and a polygonal plating of non-conductive printable material, operatively contacting the support structure, the polygonal plating having a polygon perimeter length and an aperture located therein having an aperture perimeter;

wherein configurations of the polygonal plating and the aperture are selected such that (i) a ratio of the polygon perimeter length to the area of the polygon is maximized; and (ii) a ratio of the aperture perimeter to the aperture area is minimized.

24. A patch radiator according to claim 23, wherein a conductive ink is silkscreened onto the non-conductive printable material.

25. A patch radiator according to claim 24, wherein the non-conductive printable material is polycarbonate.

* * * * *